United States Patent [19]

Egelhof et al.

[11] Patent Number: 4,783,241

[45] Date of Patent: Nov. 8, 1988

[54] HEAD BOX FOR A PAPER MACHINE

[75] Inventors: Dieter Egelhof; Albrecht Meinecke, both of Heidenheim; Simon Juhas, Nattheim, all of Fed. Rep. of Germany

[73] Assignee: J. M. Voith GmcH, Heidenheim, Fed. Rep. of Germany

[21] Appl. No.: 133,996

[22] Filed: Dec. 17, 1987

[30] Foreign Application Priority Data

Dec. 24, 1986 [DE] Fed. Rep. of Germany ..... 3644454

[51] Int. Cl.[4] ..... D21F 1/02

[52] U.S. Cl. ..... 162/347; 162/336; 162/344

[58] Field of Search ..... 162/259, 336, 344–347

[56] References Cited

U.S. PATENT DOCUMENTS

| | | | |
|---|---|---|---|
| 3,043,370 | 7/1967 | Ostertag, Jr. et al. | 162/344 |
| 3,628,589 | 12/1971 | Means et al. | 162/347 |
| 4,373,993 | 2/1983 | Fujiwari | 162/347 |
| 4,406,740 | 9/1983 | Brieu | 162/347 |
| 4,551,204 | 11/1985 | Holik | 162/347 |

*Primary Examiner*—David L. Lacey
*Assistant Examiner*—K. M. Hastings
*Attorney, Agent, or Firm*—Albert L. Jeffers

[57] ABSTRACT

A head box has a preferably fixed flow-carrying wall (11) and a movable flow-carrying wall (13) defining a nozzle-like stock conduit (14) and an outlet slot (15). The movable wall is provided with an adjustable profile bar (35) at the stock outlet slot. For coarse adjustment of the slot width, two lifting devices (21) act on the movable flow-carrying wall. Fine adjustment of the slot width is performed by adjustment spindles (36) acting on the profile bar.

To improve adjustment of the stock outlet slot by the movable wall and to use the profile bar adjustment to perform very small corrections to the slot width, a front end section (24) of the movable wall located in the region of the stock outlet slot is flexibly constructed with respect to the remaining part of the wall, and a plurality of adjustment units (33) are spaced across the machine width and act on the flexible end section directly in front of the stock outlet slot.

Thereby the movable wall (33) can be adapted with relatively high accuracy to the contour of the fixed wall (11) on the outlet slot side by the adjustment units (33) acting on the flexible end section (24). The immersion depth of the profile bar (35) into the stock conduit is therefore largely constant over the machine width. Cross currents and variable velocities of the stock flow are avoided and the paper's properties are improved.

8 Claims, 2 Drawing Sheets

HEAD BOX FOR A PAPER MACHINE

The invention relates to a head box for a paper machine or the like comprising a nozzle-like stock conduit and an outlet slot which extend over the machine width and are defined by a first, preferably fixed, flow-carrying wall and a second movable, flow carrying wall opposite thereto, an adjustable profile bar extending over the machine width at the stock outlet slot and carried by the movable wall, at least two lifting devices hinged to the movable wall and supported on the head box housing, which is fixed, for the coarse adjustment of the clearance width of the outlet slot, and a plurality of adjustment spindles over the machine width which act upon the profile bar for the fine adjustment of the clear width of the outlet slot.

Such a type of head box is known through Voith Publication p 2503. Therein a fixed flow-carrying wall is provided which is of flat construction in relation to the stock conduit, is supported on the fixed head box housing, and borders on a wire section breast roll which has a drainage wire around it. The opposite flow-carrying wall, in contrast, is constructed so that it can swing. On the side remote from the stock conduit, the wall is connected to a machine-width, rigid box beam. Lifting appliances, which act on both ends of this beam and which are pivoted on the fixed head box housing, can act on the swinging flow-carrying wall so as to effect a coarse adjustment of the width of the machine-width stock outlet slot defined between the fixed and movable flow-carrying walls. Furthermore, the movable flow-carrying wall can be constructed so that it can be displaced in the direction of the stock flow if in addition there is to be the possibility of influencing the so-called jet angle of the stock stream issuing from the stock outlet slot.

Forces generated by the pressure of the stock flow in the stock conduit and acting on the movable flow-carrying wall are transmitted to a relieving beam. This is disposed on the side of the box beam remote from the stock conduit (or inside the box beam) and connected thereto at both ends. A pressure chamber located between the two beams serves the purpose of hydraulically compensating for the forces acting on the flow-carrying wall and which elastically deform the relieving beam, but renders the box beam and the movable flow-carrying wall largely free from the effect of forces, with the result that these members at least theoretically assume the straightness produced at the time of their production.

The movable flow-carrying wall is provided with a machine-width profile bar at the outlet slot, which projects into the stock conduit and limits the clear width of the slot. In order to finely adjust the slot width, the profile bar can be deformably adjusted by means of a plurality of adjustment spindles distributed in a row over the machine width approximately at right angles to the direction of stock flow.

Despite these numerous measures to achieve a straight and planar movable flow-carrying wall and a constant outlet slot as regards slot width over the machine width, there occur variations in shape which have a disadvantageous effect on the properties of the paper produced. These variations in shape may consist in that the movable flow-carrying wall does not run parallel to the fixed flow-carrying wall at the outlet slot because there is play in the lifting appliances and the adjustment does not occur synchronously. Thermal influences can likewise result in deformation to the flow-carrying walls. These and other defects are equalized by adjusting the profile bar, which as a result dips to a varying depth into the stock conduit over the machine width. The variable contraction of the stock stream produced by the profile bar dipping into the stock conduit by varying degrees also creates a variable jet angle of the stock stream, which is undesirable. Moreover the displacement of the stock flow caused by the locally greater immersion depth of the profile bar is disadvantageous, with the result that cross currents occur at this point. Such currents generate a change in fiber position in the paper web produced, i.e. a fiber position which deviates from that in adjacent regions. However the changes in velocity of the stock flow generated by the variable immersion of the profile bar into the stock conduit are also disadvantageous because these become noticeable at varying stock flow velocities over the machine width. This results in diagonal distortions in the paper which, when used in copying devices, for example, becomes apparent by the copies often curving diagonally or becoming wavy if there are sudden large temperature rises.

Therefore the object of the invention is to create a head box of the type mentioned above, in which there is an improvement of the adjustment of the stock outlet slot width by means of the movable flow-carrying wall with the result that the extent of the profile bar adjustment can be reduced.

This object is achieved by the features characterized in the claims.

The invention is advantageous insofar that the movable flow-carrying wall can be adapted with relatively high accuracy, by means of the adjustment units acting on the flexible end section of said wall at close distances, to the contour on the outlet slot side of the fixed flow-carrying wall so as to achieve accurate parallelism of the two walls in this region. This adjustment occurs irrespective of the coarse adjustment of the slot by swinging the entire movable flow-carrying wall with the two lifting devices. The deviations of the flexible end section of the movable flow-carrying wall, which cannot be removed by elastic deformation, can be equalized by the per se known adjustment of the profile bar. According to the invention this adjustment of the profile bar however is only required within very narrow limits so that the immersion depth of the profile bar into the stock conduit over the machine width is largely constant. Consequently any unwanted cross currents in the stock flow and different stock flow velocities are reduced and the paper properties improved.

One quite substantial advantage of the invention is that the profile bar, which is subject to some wear and risk of damage, can easily be exchanged without any fundamental measures being required at the head box.

In contrast, it is known from U.S. patent specification No. 4,406,740 to have a head box in which the movable flow-carrying wall has a flexibly constructed end section on which adjustment components distributed over the machine width act for the purpose of adjusting the width of the stock outlet slot. However there is no slice blade for the fine adjustment of the slot width, with the result that this known arrangement does not achieve the precision of the adjustment as is provided by the present invention. Damage, such as scratches, impurities or crushing at the flexible end section of the movable flow-carrying wall result in considerable local deviations in the stock stream with the high stock flow velocities of modern paper machines. With such damage it is necessary to exchange the entire movable flow-crrrying wall in the case of the known head box.

Further advantageous features of the invention and three exemplified embodiments will now be described in more detail below with the aid of the accompanying drawings.

Figure 1:
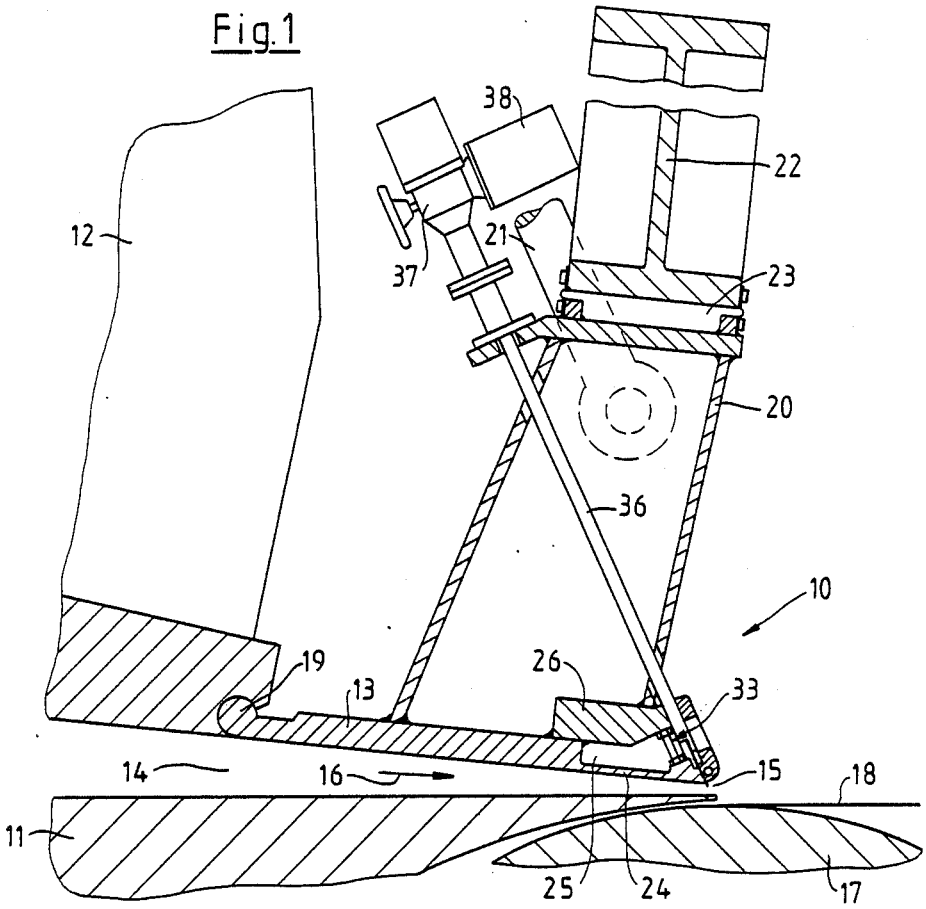
FIG. 1 shows a cross-section through a region of a head box with the devices associated with the movable flow-carrying wall for the adjustment of the width of the stock outlet slot (first exemplified embodiment)

A head box designated by 10 of a paper machine (not shown) has a lower machine-width flow-carrying wall 11, which is constructed rigidly and is connected with the head box housing 12 (FIG. 1). The head box 10 is also equipped with a movable, likewise machine-width flow-carrying wall 13 above wall 11. Both walls 11 and 13 define a nozzle-form, machine-width stock conduit 14, which ends in a machine-width stock outlet slot 15. Stock suspension supplied to the head box 10 flows through the stock conduit 14 in the direction of arrow 16 (direction of stock flow) and discharges from the slot 15 in the form of a jet which in the region of a breast roll 17 impinges upon a drainage wire 18 of a wire section (also not shown).

The movable flow-carrying wall 13 is mounted in a hinge 19 of the housing 12, the hinge 19 running in the direction of the machine width. A box beam 20 is also connected to wall 13. On each end of this beam 20 acts a respective lifting device 21, the devices 21 being pivoted on the head box housing 12 (pivoting not shown). By actuating the lifting devices 21 the movable flow-carrying wall can be swung to coarsely adjust the width of the stock outlet slot 15. On the end of box beam 20 remote from the stock conduit 14 is disposed a relieving beam 22. This is connected at both ends with the box beam 20. A pressure pad 23 lying between the two being 20 and 22 is used for the hydraulic compensation of forces acting on the flow-carrying wall 13, which forces are generated by the pressure of the paper stock flow in stock conduit 14. These forces are transmitted from the pressure pad 23 to the relieving beam 22, which is deformed, whereas the flow-carrying wall 13 remains substantially flat. The movable wall 13 can also be displaced by means not visible in the drawing in the direction of the stock flow (arrow 16) so as to influence the jet angle of the flow of stock issuing from the outlet slot 15.

Figure 2:
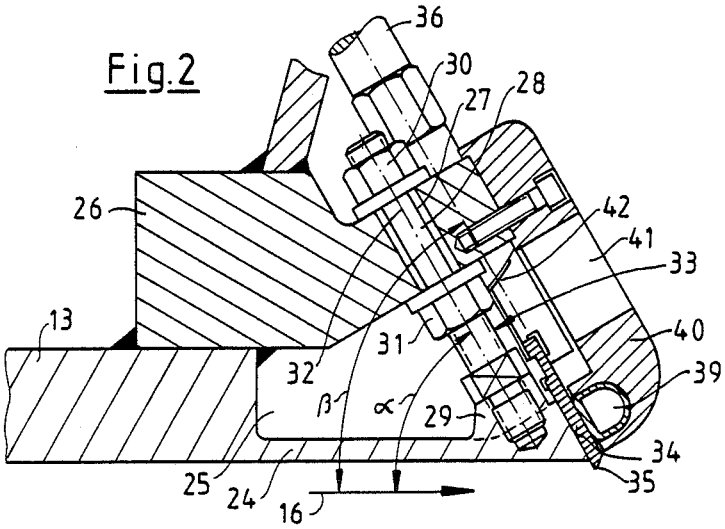
FIG. 2 shows the slot-side section of the flow-carrying wall according to FIG. 1, however on a larger scale, with adjustment units acting on a flexible end section of the wall and also adjustment spindles acting on a profile bar.

Towards the slot 15 the movable flow-carrying wall 13 is provided with a machine-width end section 24 which is elastically flexible in relation to the remaining part of the wall (FIGS. 1 and 2). This is achieved by a reduction in the cross-section of the wall 13 due to recess 25, which on the side facing the box beam 20 is covered by a rigid extension 26 of the wall. Over the machine width the extension 26 is provided with a row of equi-spaced bores 27. These are fitted with adjustment screws 28 (in the drawing concealed one behind another), which on the slot side are screwed tightly into conical projections 29 on the end section 24. The adjustment screws 28 carry nuts 30 and 31, by which they are supported on the rigid extension 26 in the direction of their longitudinal axis 32. The adjustment screws 28 act by corresponding adjustment of the nuts 30 and 31 as adjustment units 33 engaging the flexible end section 24 of the movable flow-carrying wall 13 directly in front of the stock outlet slot 15. With these adjustment units 33 an adjustment of the spacing between the flexible end section 24 at the slot and the opposite fixed flow-crrrying wall 11 can be made, independently of the coarse adjustment made by the lifting devices 21. At the same time the flexible end section 24 is elastically deformed so as to achieve the desired parallelism at the slot 15.

The flexible end section 24 is provided at its forward extremity with a supporting surface 34 for a profile bar 35 extending over the machine width and projecting at the slot 15 over the movable flow-carrying wall 13. A plurality of adjustment spindles 36 equally spaced over the machine width act on the profile bar 35. These spindles extend transversely through the box beam 20, on which they are mounted with a respective control gear 37 and stepping motor 38. The purpose of these adjustment spindles 36 is to finely adjust the width of the stock outlet slot 15 by locally moving the profile bar 35 along the supporting surface 34, i.e. by deforming the profile bar. As the flexible end section 24 at the slot 15 has already achieved high-accuracy parallelism by the adjustment units 33, the profile bar 35 only has to be adjusted very slightly. The projection of the profile bar 35 beyond the conduit facing surface of the flexible end section 24 is thus largely constant over the machine width. So that the profile bar 35 does not rise from the supporting surface 34, an expandable delivery hose 39 running along the profile bar is provided. This is supported in a row of abutments 40 (in the drawing lying behind one another), which are screwed to the rigid extension 26 of the movable flow-carrying wall 13. An aperture 41 in each abutment 40 allows access to the nut 31 of the adjustment screw 28.

Particularly typical of the previously described first exemplified embodiment of devices to adjust the clearance width of the stock outlet slot 15 is (seen at right angles to the direction of stock flow/arrow 16) the parallel arrangement of the longitudinal axes 32 of the row of adjustment units 33 for the adjustment of the flexible end section 24 and of the longitudinal axis 42 of the row of adjustment spindles 36 for the adjustment of the profile bar. These axes 32 and 42 of the two rows hereby have a small mutual spacing with respect to the cross-section shown of the head box 10. Moreover the axes 32 and 42 form the same acute angles $\alpha$ and $\beta$ respectively with the direction of stock flow (arrow 16). The supporting surface 34 and the profile blade 35 also assume this angle if the flexible end section 24 is not deformed.

The spacing of the two rows of adjustment units 33 and adjustment spindles 36 can be 70 mm, for example. So that the nuts 30 and 31 of the adjustment screws 28 are easily accessible and the mutual spacing of both rows can be kept very small (as shown), the adjustment units 33 are staggered by half the spacing distance in the direction of the machine width with respect to the adjustment spindles 36. Because the adjustment of the profile bar 35 in comparison with the flexible wall section has to meet particularly high requirements, the adjustment units 33 acting on the wall section may have greater mutual spacing than the adjustment spindles 36 of the profile bar, for example twice the spacing distance of the spindles.

This first embodiment having adjustment screws 28 with nuts as adjustment units 33 is particularly suitable for subsequent installation in existing head boxes 10, as it requires little construction space and only slight disruption is necessary. Also the adjustment spindles 36 remain in operative connection with a process control system of the paper machine. In contrast adjustment units 33 are adjusted manually, preferably when the machine is shut down.

(In the two following exemplified embodiments the reference numbers of the first embodiment are used with a subordinate numeral depending on the respective figure for components of the head box which have the same action or substantially the same form).

Figure 3:
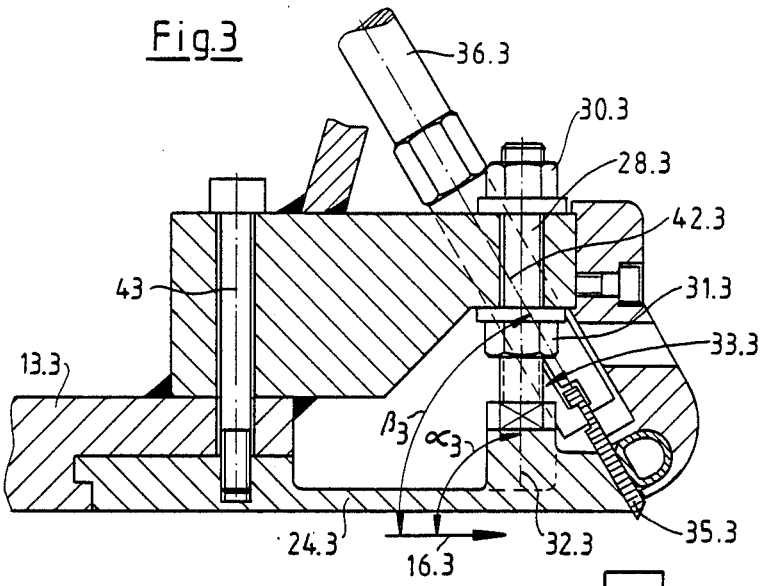
FIG. 3 shows a representation according to FIG. 2 of a second exemplified embodiment with adjustment units disposed differently from the first embodiment.

The second exemplified embodiment according to FIG. 3 differs essentially from the previous one in the following respect:

The flexible end section 24.3 consists of a plate correspondingly shaped in cross-section, which is fitted to the movable flow-carrying wall 13.3 and is secured to this by screws 43. Consequently the material of the flexible end section 24.3 can be selected in dependence upon its stress requirements and can easily be exchanged. The longitudinal axes 32.3 of the adjustment units 33.3 for the flexible end section 24.3, which are also constructed as adjustment screws 28.3 having nuts 30.3 and 31.3, form together with the direction of stock flow (arrow 16.3) a right angle $\alpha_3$. Since the longitudinal axes 42.3 of the adjustment spindles 36.3 acting on the profile bar 35.3 assume an acute angle $\beta_3$ to the direction of stock flow, the adjustment spindles intersect with the adjustment units 33.3 (as seen at right angles to the direction of flow). Therefore the adjustment units 33.3 have to be staggered over the machine width, preferably centrally between adjustment spindles 36.3, because of accessibility for adjustment purposes.

Figure 4:
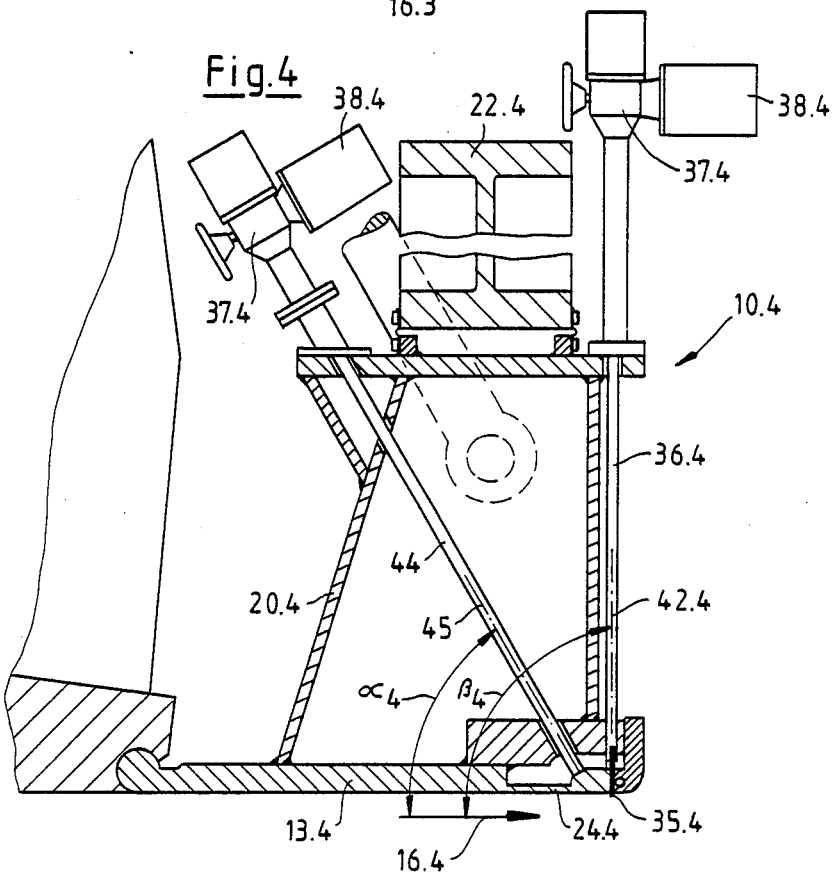
FIG. 4 shows a cross-section corresponding to FIG. 1, but with adjustment spindles acting on the flexible end section of the flow-carrying wall and on the profile bar (third exemplified embodiment).

With the third exemplified embodiment according to FIG. 4, the arrangement of two rows of adjustment spindles is to be noted. The adjustment spindles 44 acting on the flexible end section 24.4 replace the adjustment units 33 of the previous embodiments. Furthermore the longitudinal axes 45 of these spindles 44 with respect to the direction of stock flow (arrow 16.4) assume an acute angle $\alpha_4$. The spindles 44 therefore penetrate the box beam 20.4 of this head box 10.4 and outside the beam are provided with a control gear 37.4 having a stepping motor 38.4. Moreover with this embodiment the profile bar 35.4 lies in a plane extending at right angles (angle $\beta_4$) to the direction of flow (arrow 16.4). In this plane or at a small distance parallel thereto lie the longitudinal axes 42.4 of the adjustment spindles 36.4 which act on the profile bar 35.4. These are guided upwards and along on the front side on the box beam 20.4 and on the relieving beam 22.4 and are there provided with a control gear 37.4 and stepping motor 38.4. The adjustment of both the flexible end section 24.4 of the movable flow-carrying wall 13.4 and also of the profile bar 35.4 can therefore occur automatically via a process control system of the paper machine equipped with this head box 10.4.

What is claimed is:

1. A head box (10) for a paper machine comprising a nozzle-like stock conduit (14) structured to provide a flow of stock in a given direction and an outlet slot having a clearance width (15) which extend over the machine width and are defined by a first fixed, flow-carrying wall (11) and a second movable, flow-carrying wall (13) opposite thereto, an adjustable profile bar (35) extending over the machine width at the stock outlet slot (15) and carried by the movable wall (13), at least two lifting devices (21) pivoted to the movable wall (13) and supported on a head box housing (12), which is fixed, for coarse adjustment of the clearance width of the outlet slot (15), and a plurality of adjustment spindles (36) spaced over the machine width which are structured to act upon the profile bar (35) for fine adjustment of the clearance width of the outlet slot (15) the improvement comprising:

(a) a front end section (24) of the movable wall (13) located in the region of the stock outlet slot (15) is of flexible construction with respect to the remaining part of said movable wall, and (b) a plurality of adjustment units (33), spaced across the machine width, structured to act directly on the flexible front end section (24) of said movable wall in front of the stock outlet slot (15).

2. A head box according to claim 1, wherein the adjustment units acting on the flexible front end section (24.4) of the movable wall (13.4) are constructed as spindles (44).

3. A head box according to claim 2, wherein the profile bar (35.3), lies in a plane extending at an acute angle to the direction of stock flow (arrow 16.3), and further comprising:

the adjustment spindles (36.3) acting on the profile bar (35.3) each has an axis which forms the same acute angle ($\beta_3$) with the direction of stock flow (arrow 16.3), the adjustment units (33.3) acting on the front end section (24.3) of the movable wall (13.3) each has an axis which forms an obtuse angle ($\alpha_3$) with the direction of stock flow (arrow 16.3), as seen at right angles to the direction of stock flow (arrow 16.3), the adjustment splindles (36.3) which are spaced across the machine width intersect with the adjustment units (33.3).

4. A head box according to claim 2, wherein the adjustment units (33) acting on the front end section (24) of the movable wall (13) each have an axis and the adjustment spindles (36) acting on the profile bar (35) each have an axis, and the axes of the adjustment units and the adjustment spindles form acute angles ($\alpha$ and $\beta$ respectively) with the direction of stock flow (arrow 16).

5. A head box according to claim 4, wherein, as seen at right angles to the direction of stock flow (arrow 16), the axes (32 or 42 respectively) of the adjustment units (33) and of the adjustment spindles (36) extend in rows parallel to one another.

6. A head box according to claim 1, wherein the adjustment units (33) acting on the flexible front end section (24) of the movable wall (13) are constructed as adjustment screws (28), which are disposed in a rigid extension (26) of said movable wall.

7. A head box according to claim 2, further comprising:

the profile bar (35.4) lies in a plane extending at least approximately at right angles (angle $\beta_4$) to the direction of stock flow (arrow 16.4), the adjustment spindles (36.4) acting on the profile bar (35.4) each have an axis which lies at least approximately in the plane of said profile bar, the adjustment spindles (44) acting on the front end section (24.4) of the movable wall (13.4) each have an axis which forms an acute angle ($\alpha_4$) with the direction of stock flow (arrow 16.4).

8. A head box according to any one of claims 1 to 7, wherein the spacing over the machine width between the adjustment units (33) acting on the front end section (24) of the movable wall (13) is greater than the spacing of the adjustment spindles (36) of the profile bar (35).

* * * * *